US005518520A

United States Patent [19]

Hasker et al.

[11] Patent Number: 5,518,520

[45] Date of Patent: May 21, 1996

[54] DISPENSER CATHODE AND METHOD OF MANUFACTURING A DISPENSER CATHODE

[75] Inventors: Jan Hasker, Eindhoven, Netherlands; Robert H. Kane, Hohokus; Paul D. Goodell, Ridgewood, both of N.J.; Jacobus A. J. M. Deckers, Eindhoven, Netherlands

[73] Assignee: U.S. Philips Corporation, New York, N.Y.

[21] Appl. No.: 399,304

[22] Filed: Mar. 6, 1995

Related U.S. Application Data

[63] Continuation-in-part of Ser. No. 214,887, Mar. 15, 1994, Pat. No. 5,407,633.

[51] Int. Cl.[6] ..... C22C 27/04

[52] U.S. Cl. ..... 75/245; 75/248

[58] Field of Search ..... 75/228, 245, 248

[56] References Cited

U.S. PATENT DOCUMENTS

| | | | |
|---|---|---|---|
| 3,591,632 | 7/1971 | Pacini | 260/537 |
| 5,126,622 | 6/1992 | Jeong et al. | 313/346 |
| 5,236,382 | 8/1993 | Oh | 445/50 |
| 5,261,845 | 11/1993 | Van Esdonk et al. | 445/51 |
| 5,264,757 | 11/1993 | Snijkers et al. | 313/346 R |
| 5,306,189 | 4/1994 | Sugimura et al. | 445/50 |
| 5,318,468 | 6/1994 | Lotthammer et al. | 445/50 |
| 5,407,633 | 4/1995 | Hasker et al. | 419/19 |

*Primary Examiner*—Donald P. Walsh
*Assistant Examiner*—Daniel Jenkins
*Attorney, Agent, or Firm*—John C. Fox

[57] ABSTRACT

Method of manufacturing a dispenser cathode, in which method tungsten and a scandium-containing material are mechanically alloyed and the product thus formed is pressed into a cathode body. The cathode body is further provided with a barium-containing component. In the mechanical alloying process the tungsten is highly deformed and the scandium-containing material is mixed with the tungsten so as to be very finely distributed therein, so that an improved dispensation of scandium and hence an improved recovery after ion bombardment of the final cathode is attained.

15 Claims, 2 Drawing Sheets

DISPENSER CATHODE AND METHOD OF MANUFACTURING A DISPENSER CATHODE

This application is a continuation-in-part of U.S. patent application Ser. No. 214,887 filed Mar. 15, 1994 now U.S. Pat. No. 5,407,633.

BACKGROUND OF THE INVENTION

The invention relates to a dispenser cathode, comprising a refractory metal and a rare earth metal containing material, particularly a tungsten and a scandium-containing material having a cathode body which is also provided with a barium-containing component.

The invention further relates to manufacturing such a cathode.

Such a cathode and method are known from European Patent Application No. 298 558. In the known method, tungsten powder and a scandium-containing powder, consisting of pure scandium or scandium hydride, are mixed in a ratio of 95:5 % by weight, whereafter the powder mixture is compressed and sintered to form a cathode body of substantially porous tungsten in which the scandium is distributed in oxidized form. The cathode body is further provided with a barium-containing component by impregnating the cathode body with molten barium-calcium-aluminate at an elevated temperature.

Such a cathode is commonly referred to as mixed-matrix scandate cathode and comprises a porous matrix of predominantly the high-melting or refractory metal in which oxidized scandium (scandate) is distributed, the barium-containing component, generally in an oxidized form, being present in the pores of the matrix.

The oxidized states of scandium and barium will hereinafter be referred to as scandium oxide and barium oxide, respectively. However, unless expressly stated, they are not limited to pure stoichiometric compounds. For example, the oxidized states can contain intermediate forms of stoichiometric oxides, so-called mixed oxides. Also, if hereinafter reference is made to scandium this should not be construed as to be limited merely to pure, atomic scandium but might as well relate to some kind of scandium compound, and particularly to scandium oxide.

The barium-containing component facilitates the formation of a mono-atomic layer which contains barium at the emissive surface of the cathode. Said barium originates from the barium-containing component in the cathode body, which component is reduced to barium by the matrix metal. By virtue of the mono-atomic top layer, the work function of free electrons in the matrix is sufficiently reduced to enable electron emission. Since the mono-atomic top layer continuously looses barium as a result of the inevitable evaporation of barium, barium must be dispensed continuously to preserve the layer, which explains the name of such a cathode. Said dispensation takes place in that, during operation, barium oxide, which may be reduced already, migrates from the pores to the emissive surface where it replenishes the mono-atomic layer.

In such a mixed-matrix scandate cathode, the work function of the electrons is further reduced due to the fact that in addition to barium the mono-atomic top layer also contains scandium. As a result, such a cathode has an extremely high efficiency, enabling a relatively strong electron emission to take place at relatively low temperatures. For example, a cathode of the type mentioned in the opening paragraph enables an electron emission above 100 A/cm$^2$ to be realised at a comparatively low operating temperature of approximately 1000° C., said electron emission being more than a factor of 10 higher than that of a dispenser cathode which does not comprise scandium. Consequently, a cathode of the type mentioned in the opening paragraph is very suitable for use in an electron tube, in particular a display tube in which an image is displayed on a display screen by means of an electron beam generated by the cathode, or a pickup tube in which picture information is read from a target by means of an electron beam generated by the cathode.

However, a problem which arises when the cathode is used in the above-described way is the inevitable presence of a small quantity of residual gases in the vacuum tube. These gas molecules can be ionized by the electron beam or otherwise, so that positive ions are subsequently accelerated towards the emissive surface of the cathode by the prevailing electric fields, where they are incident on the vulnerable mono-atomic top layer. Consequently, this top-layer will soon disappear, if both barium oxide and scandium oxide are not continuously dispensed to the layer.

OBJECTS AND SUMMARY OF THE INVENTION

It is an object of the invention to provide, inter alia, a cathode of the type mentioned in the opening paragraph which has an improved recovery after ion bombardment and hence a longer lifetime.

It is a further object to provide a method by means of which such a dispenser cathode can be manufactured.

To this end, a cathode of the type mentioned in the opening paragraph is characterized according to the invention in that the rare earth metal containing material is present in a matrix of the refractory metal as distributed particles the major part of the particles having a diameter of 200 nm or less.

A method for manufacturing such a cathode is characterized in that the refractory metal and the rare earth metal containing material are mechanically alloyed and in that the granules thus formed are pressed into a cathode body.

The invention is based on the recognition that, in practice, the relatively low rate of dispensation of scandium oxide seriously limits the lifetime of the mono-atomic layer and hence the lifetime of the cathode as a whole, since, at the operating temperature, scandium oxide in the cathode body has a much lower mobility than barium oxide.

The invention is further based on the recognition that the scandium oxide can be dispensed more quickly and with better results as the average distance to be travelled by the scandium oxide from the pores of the cathode body over the entire surface, hereinafter referred to as diffusion distance, is smaller and that said diffusion distance is, on average, smaller as the scandium oxide is more finely distributed in the cathode body.

A conventional alloying process in which the scandium-containing material and the tungsten are mixed in a molten state does not lead to a sufficiently homogeneous distribution of the scandium oxide in the cathode body because, in fact, segregation of the molten tungsten and scandium-containing material takes place in the process. Besides, scandium under normal pressure will have evaporated completely at the melting point of tungsten, so that a homogeneous alloy of both metals is impossible.

A sufficiently homogeneous distribution of the scandium oxide in the cathode body can however be obtained by mechanically alloying the tungsten and the scandium-containing material in accordance with the invention. "Mechanical alloying" is to be understood to mean herein that the starting materials are subjected to mechanical action in such a manner that an alloy of said starting materials is formed. This mechanical action can be carded out, for example, by introducing the starting powders and hard balls into a container which may or may not be provided with blades, and subsequently rotating and/or shaking the content of the container relatively vigorously, whether or not under a protective gas. Such a process is described in, for example, U.S. Pat. No. 3,591,362.

Mechanical alloying not only leads to a very fine homogeneous distribution of the scandium-containing material in the cathode body, but also to a great number of dislocations in the tungsten. In the cathode body, such dislocations promote the migration of the scandium-containing material to the emissive surface, thereby causing the diffusion rate and hence the dispensation of the scandium-containing material to increase. The scandium containing material is present as small particles (<200 nm or even <100 nm). Preferably the scandium content in such a cathode is between 0,5 and 2 weight percent. The density of scandium containing particles in the matrix then lies between 1 and 40.000 scandium containing particles per $(\mu m)^3$.

In accordance with a particular embodiment of the method in accordance with the invention, the barium-containing component and the two above-mentioned powders are all subjected to the mechanical alloying process. In that case, not only are the tungsten and the scandium-containing component very homogeneously mixed but, in addition, the barium-containing component is very finely distributed in said mixture. In contrast with the known method, the barium-containing component no longer has to be added in the molten state to the already pressed cathode body. In this manner, leaching of the scandium-containing material is precluded. The fact is that common scandium-containing materials, such as pure scandium, scandium oxide, scandium hydride and scandium nitride completely or partially dissolve in molten barium-calcium-aluminate, which latter material is often used as the barium-containing component.

Moreover, After the cathode body has been pressed, it is usually sintered at an increased temperature. It has been found that the presence of the barium-containing component in the cathode body decelerates the sintering process, thereby rendering the process more controllable. This is important, in particular, in the method according to the invention because it has been found that the sintering time decreases dramatically as the scandium-containing material and the tungsten are more finely mixed.

Very good results with respect to migration of the scandium-containing material of the emissive surface are obtained if this surface has a rhenium-coating.

The coating should have a minimum thickness of 0,05 μm to prevent it from being sputtered away while its maximum thickness is 5 μm to prevent it from closing the gates of the body. Optimum dimensions lie within 0,1–1 μm.

In a preferred embodiment of the method in accordance with the invention, tungsten balls and a tungsten container are used in the mechanical alloying operation. Such balls are sufficiently hard for use in the mechanical alloying operation and, in addition, do not lead to the introduction of detrimental impurities into the final product.

BRIEF DESCRIPTION OF THE DRAWINGS

The invention will be explained in greater detail by the description of an exemplary embodiment with reference to a drawing, in which.

DESCRIPTION OF THE PREFERRED EMBODIMENTS

Figure 1:
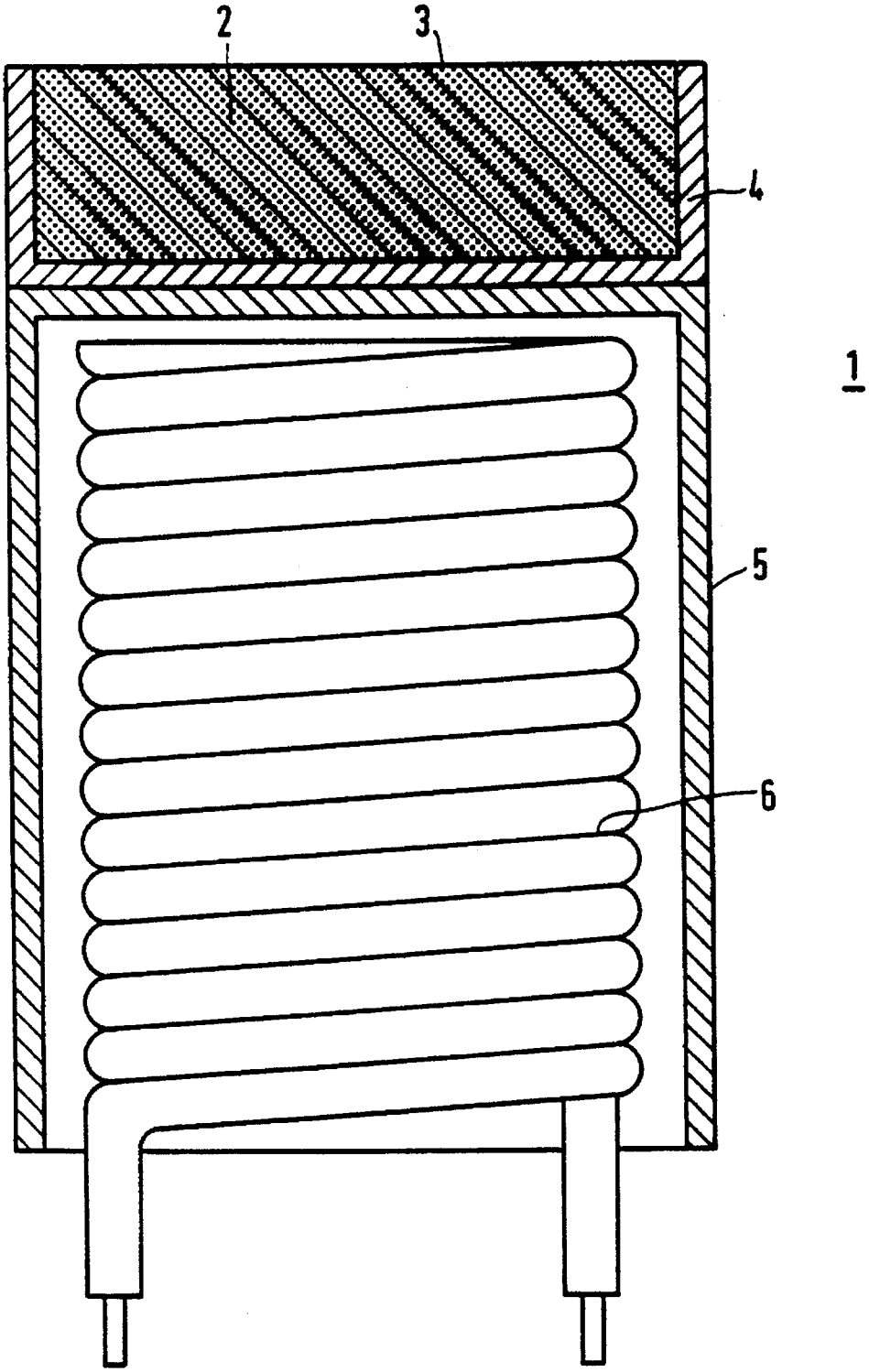
FIG. 1 shows a dispenser cathode in accordance with the invention.

The Figures are purely schematic and not drawn to scale. For clarity, certain dimensions have been exaggerated strongly. As far as possible, corresponding parts in the Figures bear the same reference numerals.

For the manufacture of a dispenser cathode, the necessary quantifies of tungsten powder having an average grain size of approximately 2–6 μm, and scandium-containing material, in this example scandium-oxide powder having an average grain size up to approximately 20 μm, are introduced into a tungsten container which can be sealed hermetically. Instead of scandium oxide, for example, pure scandium powder or scandium-hydride powder or scandium-nitride powder can alternatively used and, if necessary, a small quantity of molybdenum powder or powder of another high-melting metal can be added to the powder mixture. In the present example, a barium-containing component in the form of a specific quantity of barium-calcium-aluminate powder, for example barium oxide (BaO) aluminium oxide ($Al_2O_3$) and calcium oxide (CaO) in a molecular ratio of 4:1:1, is also added to the powder mixture.

The container is further provided with a number of tungsten-carbide balls having a diameter of approximately 4 mm, in a volume ratio of, for example, approximately 4:1 relative to the constituents to be alloyed. The container is subsequently sealed and thoroughly rinsed with a suitable inert protective gas, such as argon and helium.

The sealed container is then vigorously shaken at high speed so that the balls act upon the powder mixture with great force, thereby forming granules in which the scandium oxide is homogeneously and very finely distributed in the tungsten. Thus, a mechanical process is used to form an alloy of tungsten and a scandium-containing material, the alloy predominantly comprising highly deformed tungsten, with the scandium-containing material and the barium-containing component being homogeneously and very finely distributed therein. The dislocations formed in the tungsten in this process promote the migration of the scandium-containing component in the alloy, thereby accelerating such migration. Moreover, by virtue of the very fine uniform distribution of the scandium-containing material in the tungsten, the average diffusion distance of the scandium-containing material is substantially reduced. Both factors lead to an enhanced dispensation of the scandium-containing component to the mono-atomic top layer of the cathode, as a result of which the final cathode is more resistant to ion bombardment and has a longer lifetime.

The effective distribution of scandium containing particles depends on the amount of scandium containing material and the dimension of the particles. Using 0,5 weight percentage of $Sc_2O_3$ in the starting mixture leads to density of 1 particle per $(\mu m)^3$ for particles having an average diameter of 200 nm, while 2 weight percent leads to a density of 40.000 per $(\mu m)^3$ for particles having an average diameter of 10 nm.

Such an alloy cannot be obtained by means of a conventional alloying process in which both materials are mixed in the molten state, because molten tungsten and scandium will segregate and, under normal pressure, the scandium will have evaporated completely at the melting point of tungsten.

The granules are introduced into a mould in which the powder is pressed by means of a die under a high pressure into one or more pellets having a diameter of approximately 1 mm and a porosity of approximately 20–30%, each pellet forming a cathode body. The cathode bodies thus formed are then sintered at a temperature in the range from 1200° to 1500° C. for approximately 5–50 minutes, dependent upon the duration and the force of the mechanical alloying process. The barium-containing component, in this case barium-calcium-aluminate, which is present in the cathode body by that time, decelerates the sintering process which in the absence of impregnate would have been completed uncontrollably rapidly due to the very fine distribution of the scandium oxide.

The cathode body 1 thus obtained is introduced into a suitable holder 4 of a refractory metal, in this example molybdenum, see FIG. 1. The holder is welded onto a cathode shank 3 which is also made of molybdenum and which accommodates a filament 6 which serves to heat the cathode to the required operating temperature. The cathode is then mounted in a cathode ray tube.

The same starting materials have been used for the manufacture of a cathode in accordance with the above method and in accordance with a known method, in which the tungsten powder and scandium oxide powder only are mixed conventionally and then pressed into a cathode body. Said cathode body is subsequently sintered and impregnated with molten barium-calcium-aluminate.

Figure 2:
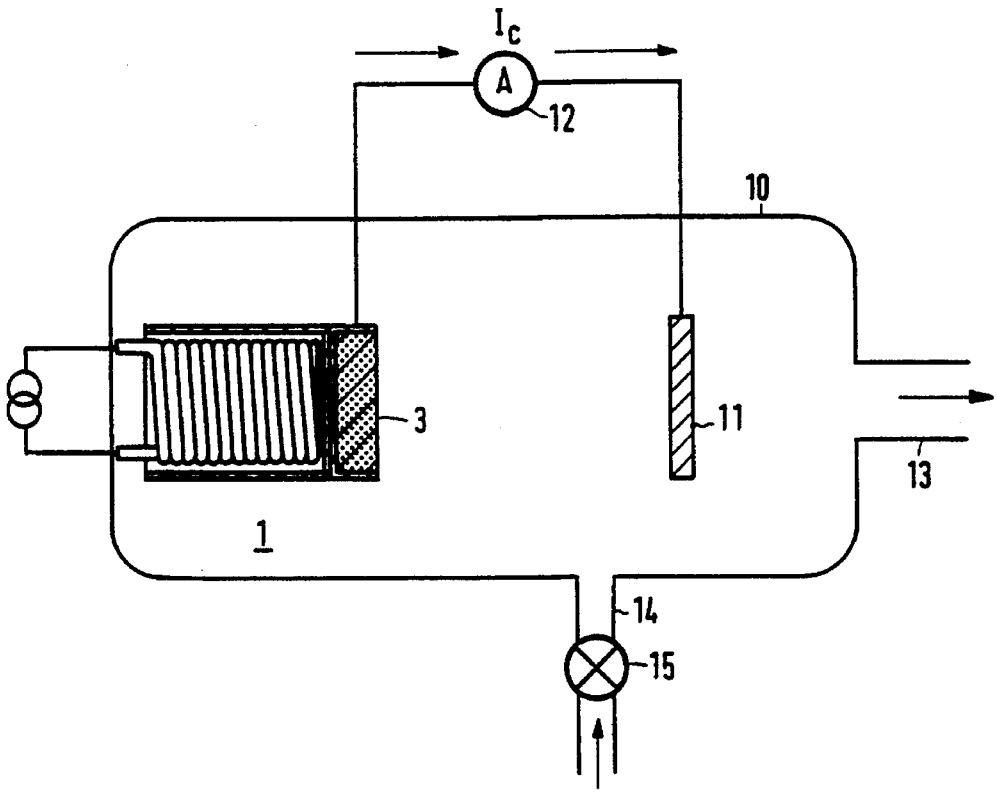
FIG. 2 shows an experimental setup for determining the resistance of such a cathode to ion bombardment.

FIG. 2 diagrammatically shows an experimental setup suitable to compare the cathode in accordance with the invention to said conventional cathode. The experimental setup comprises a vacuum bell jar 10 in which the cathode 1 can be accommodated. The vacuum bell jar further comprises a collector electrode 11 which is arranged opposite the emissive surface 3 of the cathode 1, and to which a relatively high voltage of approximately 0.5 kV is applied in operation. In operation, the collector electrode 11 can be used to measure and continuously monitor the emission of the cathode 1. The output current $I_c$ of the collector electrode 11, which can be recorded by an ammeter 12, corresponds to the total electron emission of the cathode 1. The bell jar 10 also comprises a pump connection 13 and an inlet 14 for selectively introducing argon or another gas via a valve 15.

To compare the cathode in accordance with the invention to the known conventional cathode, both cathodes were accommodated in the experimental setup one after the other, and heated to an equal operating temperature of approximately 1000° C. In either case a comparable collector current was measured, which means that the electron-emission values were comparable. In order to be able to determine the recovery of the cathode after ion bombardment, argon was introduced via connection 14 for a short period of time. The argon introduced will be rapidly ionized in the bell jar by the electron current and will then be accelerated towards the emissive surface 3 of the cathode. As a result of this argon bombardment, the vulnerable scandium and barium-containing mono-atomic top layer on the emissive surface 3 of the cathode will be sputtered away almost instantly, causing the electron emission to decline. Said argon is then evacuated via the pump connection 13 after which the electron emission of the cathode will increase again.

Figure 3:
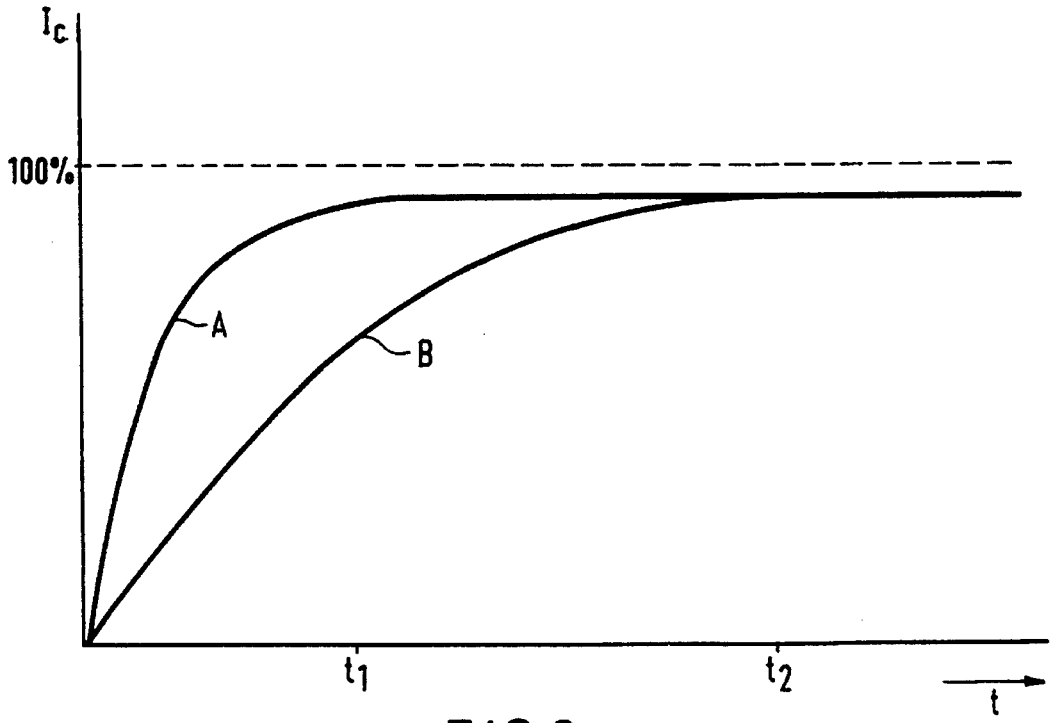
FIG. 3 shows the recovery after ion bombardment of a cathode manufactured in accordance with the invention and of a conventionally manufactured cathode.

In FIG. 3, this increase in electron emission after the argon bombardment is shown for both cathodes, the collector current $I_c$ being plotted on the vertical axis as a percentage of the initial value, i.e. the value before the argon bombardment, and time being plotted on the horizontal axis. Curve A shows the collector current as a function of time for the cathode in accordance with the invention, while curve B shows the same current for the known cathode. The Figure clearly shows that the curve of the cathode in accordance with the invention is much steeper than that of the known cathode, and hence the cathode in accordance with the invention recovers much quicker from the ion bombardment than the known cathode. The cathode in accordance with the invention has already completely recovered from the bombardment at $t=t_1$, whereas the known cathode does not reach the same degree of recovery until $t=t_2$.

This difference in recovery is ascribed to the improved dispensation of scandium in the cathode in accordance with the invention. By mechanically alloying the starting powders in accordance with the invention, a very fine, uniform distribution of the scandium-containing component in the cathode body can be attained, so that the diffusion distance of the scandium-containing component in the cathode body is drastically reduced. In addition, the dislocations formed in the tungsten in the mechanical alloying operation lead to a higher diffusion rate of the scandium. Both factors ensure that the scandium-containing component can diffuse more rapidly towards the emissive surface to dispense scandium to the mono-atomic top layer, which expresses itself in a difference of $t_2-t_1$ in recovery time after a complete ion bombardment. An additional advantage is that by virtue of the higher dispensation rate of scandium, the useful stock of scandium in the cathode body from which the top layer can draw is larger, so that, also from this point of view, the lifetime of the final cathode is increased. Thus, the invention provides a dispenser cathode having a high electron emission, a better resistance to ion bombardment and a longer lifetime. Consequently, the cathode thus manufactured is particularly suitable for use in an electron tube, such as a display tube or pickup tube, in which there will always be a certain degree of ion bombardment due to the inevitable presence of a certain amount of residual gases.

Although the invention has been described by means of the above example, it will be obvious that the invention is not limited thereto. Within the scope of the invention, many variations are possible to those skilled in the art.

As has been mentioned in the introductory part migration of the scandium containing particles and hence the dispensation rate of scandium can be enhanced by coating the emissive surface with a rhenium coating having a thickness between 0,05 μm and 5 μm. Such a coating has similar effects in dispenser cathodes manufactured by other methods, like the conventional methods of manufacturing dispenser cathodes.

For example, the cathode body need not be manufactured entirely in accordance with the example described above, but may alternatively comprise a support of a suitable metal, for example molybdenum or nickel, to which a top layer is applied which is manufactured in accordance with the method of the invention. Such a cathode is usually referred to as top-layer cathode. Besides, instead of being formed in a mould, the cathode body can be directly pressed into the cathode holder, and subsequently sintered in situ or drawn to a wire.

Moreover, instead of adding the barium-containing component during the alloying process, it is alternatively possible to add said component after the cathode body has been pressed by covering the cathode pellets with a powdered barium-calcium-aluminate and heating the whole to a temperature above its melting temperature for a short time. In that case, the molten aluminate is absorbed by the pellets through capillary action and hence the pellets are saturated with the aluminate. Afterwards, the pellets are washed with demineralised water to remove any excess impregnate.

It should be taken into account, however, that scandium oxide partially dissolves in the molten aluminate. By using a certain excess of scandium oxide powder it can be ensured that the cathode body is not completely leached of scandium oxide, so that sufficient scandium oxide remains behind in the cathode body. Usually, said scandium oxide will have been carried to the pores of the cathode body by the impregnate.

The barium-containing component can alternatively be added to the granules prior to the pressing operation. In this case, as in the exemplary embodiment, the barium-containing component is present in the cathode body before sintering takes place, which increases the controllability of the sintering process.

In general, the invention provides a method of manufacturing a dispenser cathode having an extremely homogeneous distribution of both the tungsten and the scandium-containing material in the cathode body, which contributes to an improved recovery after ion bombardment.

We claim:

1. A dispenser cathode having a cathode body comprising a refractory metal and a rare earth metal containing material which body is also provided with a barium containing component, characterized in that the rare earth metal containing material is present in a matrix of the refractory metal as distributed particles the major past of the particles having a diameter of 200 nm or less.

2. A dispenser cathode having a cathode body comprising a refractory metal and a rare earth metal containing material which body is also provided with a barium containing component, characterized in that the cathode body comprises a mechanically alloyed alloy of the refractory metal and the rare earth metal containing material.

3. A dispenser cathode as claimed in claim 1, characterized in that the major part of the particles has a diameter of 100 nm or less.

4. A dispenser cathode as claimed in claims 1, characterized in that the particles are homogeneously distributed within the matrix.

5. A dispenser cathode as claimed in claim 1, characterized in that the refractory metal is tungsten and the rare earth metal is scandium.

6. A dispenser cathode as claimed in claim 5, characterized in that the weight percentage of scandium containing material in the cathode body is between 0,5% and 2%.

7. A dispenser cathode as claimed in claim 5, characterized in that it contains 1–40.000 particles per $(\mu m)^3$.

8. A dispenser cathode as claimed in claim 1, characterized in that the emitting surface of the cathode is provided with a coating comprising rhenium, the coating having a thickness between 0,05 μm and 5 μm.

9. A cathode ray tube comprising a dispenser cathode as claimed in claim 1.

10. A dispenser cathode as claimed in claim 2, characterized in that the major part of the particles has a diameter of 100 nm or less.

11. A dispenser cathode as claimed in claim 2, characterized in that the particles are homogeneously distributed within the matrix.

12. A dispenser cathode as claimed in claim 3, characterized in that the particles are homogeneously distributed within the matrix.

13. A dispenser cathode as claimed in claim 2, characterized in that the refractory metal is tungsten and the rare earth metal is scandium.

14. A dispenser cathode as claimed in claim 3, characterized in that the refractory metal is tungsten and the rare earth metal is scandium.

15. A dispenser cathode as claimed in claim 4, characterized in that the refractory metal is tungsten and the rare earth metal is scandium.

* * * * *